US010301169B1

(12) United States Patent
Bjarle

(10) Patent No.: US 10,301,169 B1
(45) Date of Patent: May 28, 2019

(54) BRIDLES FOR EQUINES

(71) Applicant: PS of Sweden AB, Nyköping (SE)

(72) Inventor: Karin Bjarle, Stockholm (SE)

(73) Assignee: PS of Sweden AB, Nyköping (SE)

( * ) Notice: Subject to any disclaimer, the term of this patent is extended or adjusted under 35 U.S.C. 154(b) by 663 days.

(21) Appl. No.: 14/724,752

(22) Filed: May 28, 2015

(51) Int. Cl.
*B68B 1/04* (2006.01)
*B68B 1/06* (2006.01)

(52) U.S. Cl.
CPC . *B68B 1/04* (2013.01); *B68B 1/06* (2013.01)

(58) Field of Classification Search
CPC ..... B68B 1/04; B68B 1/06; B68B 1/02
USPC ..... 54/6.1, 7
See application file for complete search history.

(56) References Cited

U.S. PATENT DOCUMENTS 2,669,816 A * 2/1954 Pletsch ..... B68B 1/04 54/6.1
3,981,124 A * 9/1976 Kibler ..... B68B 1/04 24/164
4,953,345 A * 9/1990 Boone ..... B68B 1/04 54/13
6,691,497 B1 * 2/2004 Rodgers ..... B68B 1/02 54/24
2004/0159082 A1 * 8/2004 Gray ..... B68B 1/04 54/36
2004/0168413 A1 * 9/2004 Rodgers ..... B68B 1/02 54/6.1
2008/0060323 A1 * 3/2008 Crespel ..... B68B 1/04 54/6.1
2008/0236111 A1 * 10/2008 Brooks ..... B68B 1/04 54/6.1
2009/0223181 A1 * 9/2009 Mohan ..... B68B 1/04 54/6.1
2012/0315317 A1 * 12/2012 O'Hara ..... A01N 25/08 424/414

FOREIGN PATENT DOCUMENTS

DE 10331521 A1 * 2/2005 ..... B68B 1/04

OTHER PUBLICATIONS

DEE-10331521-A1 machine translation (Year: 2005).*

* cited by examiner

*Primary Examiner* — Son T Nguyen
(74) *Attorney, Agent, or Firm* — Olive Law Group, PLLC

(57) ABSTRACT

The present disclosure relates to a bridle for an equine. Such a bridle comprises a headstall, opposite ends of which presenting a respective bifurcation providing a cheek piece and a noseband, a browband, opposite ends of which being connected to the headstall near the bifurcation, a bit connector, provided at an end of one of the cheek pieces, and a noseplate, adapted to extend over the equine's nose. The headstall presents a varying width, with a maximum width being at least 200% of a minimum width. The browband is releasably connected to the headstall, such that it can be removed while the bridle is fitted to the equine. The bit connector comprises an inner loop and an outer loop, the inner loop being more resilient than the outer loop, whereby the inner loop is enclosed by the outer loop and smaller than the outer loop, such that the bit ring is simultaneously receivable in the inner and outer loops. The noseplate comprises inner and outer layers, wherein the outer layer provides a connection to one of the cheek pieces and wherein the inner layer is less rigid than the outer layer.

15 Claims, 9 Drawing Sheets

BRIDLES FOR EQUINES

TECHNICAL FIELD

The present disclosure relates to bridles for equines, such as horses.

BACKGROUND

Bridles are well known and used to facilitate control of equines, such as horses. The bridle is fitted onto the head of the horse, and provides a connection for the reins and the bit.

U.S. Pat. No. 3,981,124 discloses an example of a bridle comprising a headstall, a browband, cheek pieces, a throat latch and a noseplate.

However, a bridle may, under certain circumstances, partly depending on the horse's anatomy, partly depending on the setting of the bridle, provide discomfort, pain, or even injury to the horse.

Moreover, fitting the bridle to the horse may, for example when the horse is distracted or nervous, present some challenge to the user.

Finally, there is a desire among some users to be able to customize the bridle, e.g. by attaching decorative elements and/or by exchanging parts of the bridle for other parts having a preferred function and/or appearance.

Hence, there is room for improvements relating to bridles.

SUMMARY

An object of the present disclosure is to provide a bridle which is more comfortable for the horse and which reduces the risk of pain or injury to the horse.

Yet another object is to provide a bridle that is easier to handle and that can be more easily adapted to fit the horse and to appeal to the user.

The invention is defined by the appended independent claims, with embodiments being set forth in the dependent claims, in the following description and in the drawings.

According to a first aspect, there is provided a bridle for an equine, comprising a headstall, opposite ends of which presenting a respective bifurcation providing a cheek piece and a noseband, a browband, opposite ends of which being connected to the headstall near the bifurcation, a bit connector, provided at an end of one of the cheek pieces, and a noseplate, adapted to extend over the equine's nose. The headstall presents a varying width, with a maximum width being at least 200% of a minimum width, wherein the browband is releasably connected to the headstall, such that it can be removed while the bridle is fitted to the equine. The bit connector comprises an inner loop and an outer loop, the inner loop being more resilient than the outer loop, whereby the inner loop is enclosed by the outer loop and smaller than the outer loop, such that the bit ring is simultaneously receivable in the inner and outer loops. The noseplate comprises inner and outer layers, wherein one of the inner and outer layers provides a connection to the noseband and wherein the other one of the inner and outer layers is less rigid than the other.

Such a bridle provides increased comfort for the horse and reduces the risk of the horse being subjected to pain or even injury.

The headstall may comprise inner and outer layers, wherein the outer layer provides a connection to one of the cheek pieces and wherein the inner layer is less rigid than the outer layer The headstall may comprise a padding layer, arranged between the inner and outer layers.

An edge of the inner layer may, over at least part of the headstall, extend outside an edge of the outer layer.

A central portion of the headstall may present at least one recess providing reduced rigidity of the central portion.

A central portion of the headstall may present an adjustment device for adjusting a curvature of the headstall.

A forward edge of the headstall may present at least one edge cut-out for receiving the equine's ears.

The maximum width portion may be located at the central part of the headstall.

An end portion of the browband may present a connector for releasable connection to the headstall.

The connector may comprise at least one flap, which is adapted to encircle an end portion of the headstall.

The connector may comprise a locking device for locking the flap to the browband end portion while the flap encircles the headstall end portion.

The bit connector may be integrated with one of the cheek pieces.

In the bridle as described above, the outer loop may be formed by a first strap and the inner loop may be formed by a second strap, which is more resilient than the first strap. A proximal portion of the second strap may be attached to a proximal portion of the first strap and a distal portion of the second strap may be attached to a distal portion of the first strap. A length between the distal and proximal portions of the first strap may be greater than a length between the distal and proximal portions of the second strap.

The distal portion of the straps may be releasably connectable to the proximal portion of the straps, such that the loops are formed when such connection is provided.

A distal portion of the second strap may be less resilient than the proximal portion of the second strap. For example, the distal portion of the second strap may be at least partially made of a different material than the proximal portion of the second strap.

This part which is made of a different material may be attached to the first strap at one or more spaced apart points along its length, and/or by stitching along one or both longitudinal edges.

The distal portion of the second strap may comprise at least one inwardly facing connector for receiving a corresponding connector arranged on the proximal portion of at least one of the first and second straps. The connectors may thus be hidden by the first strap when the connectors are in an engaged state.

The noseplate may be connected to one of the noseband, such that the noseplate is slidable along a portion of the noseband.

The noseplate may be connected to one of the noseband at a portion of the noseband having substantially circular cross section, such that the noseplate is rotatable about the portion of the noseband.

The bit connector may be connected to a distal end of the cheek piece.

The noseplate may be connected to an extension of the noseband.

The noseband may present an extension, comprising an upwardly curved portion, which is positioned behind the bit and which extends upwardly, past the cheek piece.

The extension may present a portion which is plastically deformable.

The noseplate may be connected to the noseband at a position on a side of the nasal bridge, above the bit.

The bridle may further comprise a lower noseplate, extending downwardly from the position where the noseplate is connected to the noseband and below the equine's chin.

According to a second aspect, there is provided a bridle for an equine, comprising a browband, opposite ends of which being connected to a headstall near a bifurcation where the headstall connects to at least one cheek piece. The browband is releasably connected to the headstall, such that it can be removed while the bridle is fitted to the equine.

An end portion of the browband may present a connector for releasable connection to the headstall.

The connector may comprise at least one flap, which is adapted to encircle an end portion of the headstall.

The connector may comprise a locking device for locking the flap to the browband end portion while the flap encircles the headstall end portion.

According to a third aspect, there is provided a bridle for an equine, comprising a noseplate, adapted to extend over the equine's nose, and at least one cheek piece. The noseplate comprises inner and outer layers, wherein one of the inner and outer layers provides a connection to the noseband and wherein the other one of the inner and outer layers is less rigid than the other.

The noseplate may be connected to the cheek piece, such that the noseplate is slidable along a portion of the cheek piece.

The noseplate may be connected to the cheek piece, at a portion of the cheek piece having substantially circular cross section, such that the noseplate is rotatable about the portion of the cheek piece.

The portion of the cheek piece may be plastically deformable.

The noseplate may be connected to the cheek piece at a position on a side of the nasal bridge, above a bit.

The bridle may further comprise a lower noseplate, extending downwardly from the position where the noseplate is connected to the cheek piece and below the equine's chin.

According to a fourth aspect, there is provided a bridle for an equine, comprising a headstall, opposite ends of which presenting a respective bifurcation providing a cheek piece and a noseband. The headstall presents a varying width, with a maximum width being at least 200% of a minimum width.

According to a fifth aspect, there is provided a bridle for an equine, comprising at least one cheek piece, and a bit connector, provided at an end of one of the cheek piece. The bit connector comprises an inner loop and an outer loop, the inner loop being more resilient than the outer loop, whereby the inner loop is enclosed by the outer loop and smaller than the outer loop, such that the bit ring is simultaneously receivable in the inner and outer loops.

According to a sixth aspect, there is provided a martingale for an equine, comprising a first end, adapted for connection to a girth, and a second end, which is bifurcated into at least two sub ends for connection to a respective rein. At least one of said sub ends is provided with an openable connector element comprising a loop, such that the rein is insertable into the connector element by a movement perpendicular to a length direction of the rein.

The connector element may comprise a jaw, which is biased towards a closed position.

The connector element may be selected from a group consisting of a lobster clasp and a carabiner.

DETAILED DESCRIPTION

In the following description, directions such as forward, backward, rear, front, side, up, above, down and below are to be understood based on a horse standing up and with its head facing forward.

Figure 1:
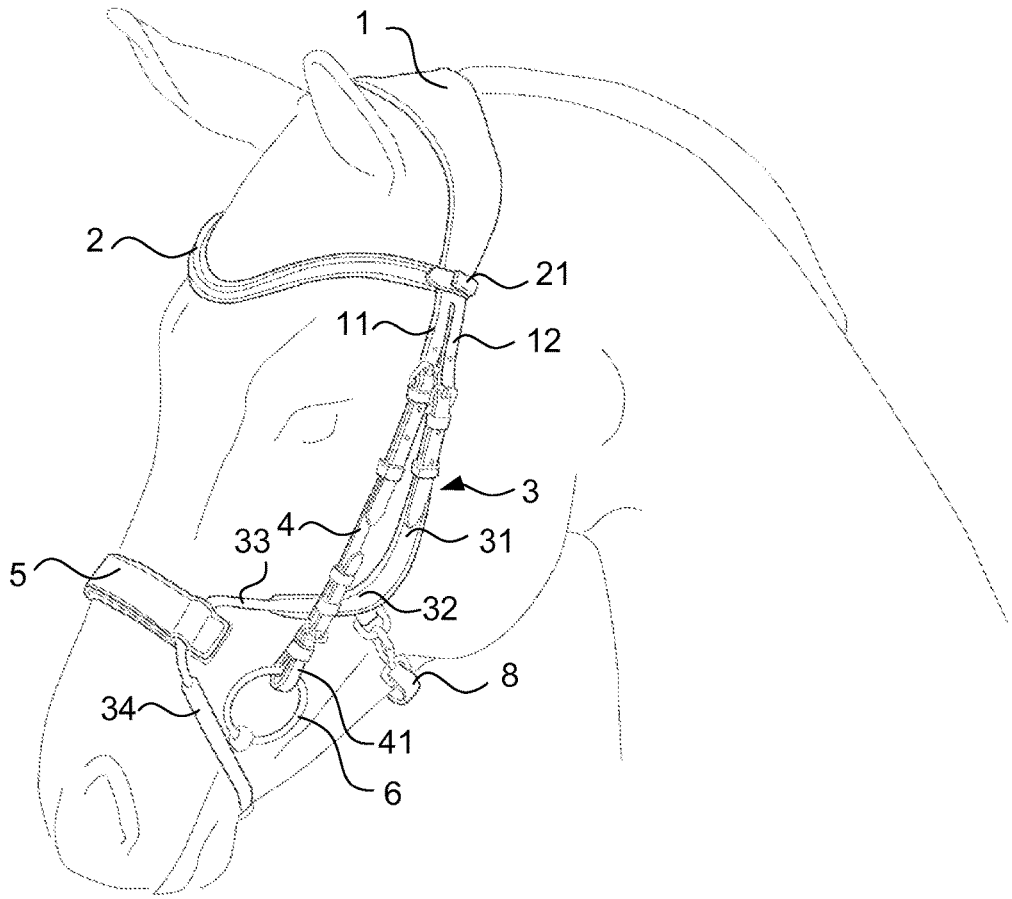
FIG. 1 schematically illustrates a horse wearing a bridle.

FIG. 1 illustrates a head of a horse wearing a bridle according to the present disclosure. The bridle comprises a headstall 1, a browband 2, a cheek piece 4 and a noseband 3 on each side of the head, a bit connector 41, a bit ring 6 and a bit (not shown), a noseplate 5 and a throat latch 8. The bridle may be formed of straps of one or more materials, such as leather, fabric or reinforced polymer material.

The headstall 1 comprises an elongate part, end portions of which connect to the cheek pieces 3 and 4 on the sides of the head, e.g. slightly below/behind the horse's eye.

The end portions may present a respective bifurcation, thus providing a pair of sub end portions 11 and 12 at each side of the horse's head. These sub end portions 11 and 12 may form part of, or connect to, a respective cheek piece 4 and 3.

That is, an upper sub end portion 11 may form part of, or connect to, a cheek piece 4 and a lower sub end portion 12 may form part of, or connect to, a noseband 3.

In the illustrated example, the noseband 3 presents a first portion 31 which is substantially straight and parallel+/−less than 10° with the cheek piece 4. The noseband 3 may further present a second portion 32, which is curved upwardly, such that it crosses the cheek piece 4, for example below the latter.

At the curved portion 32, the throat latch 8 may be releasably attached.

The curved portion 32 may present an increased width as compared to the first portion 31. Such increased width may be 125%-200% of the width of the first portion 31.

Following the curved portion 32, essentially above a bit or bit ring 6 and near the nasal bridge of the horse, there may be provided a noseplate attachment portion 33.

The noseplate 5 may be slidably attached to the noseplate attachment portion 33, such that the height position of the noseplate 5 is adjustable.

The noseplate attachment portion 33 may present a substantially circular cross section, such that substantially no, or very little, torque can be transferred from the noseplate 5 to the noseplate attachment portion 33.

The noseplate attachment portion 33 may be plastically deformable. For example, this portion may comprise a core of a metal wire, engulfed in a polymeric material and optionally coated with a fabric or leather enclosure.

Forward of the noseplate attachment portion 33, there may be provided a lower noseplate 34, extending below the horse's chin and forward of the bit.

Figure 2:
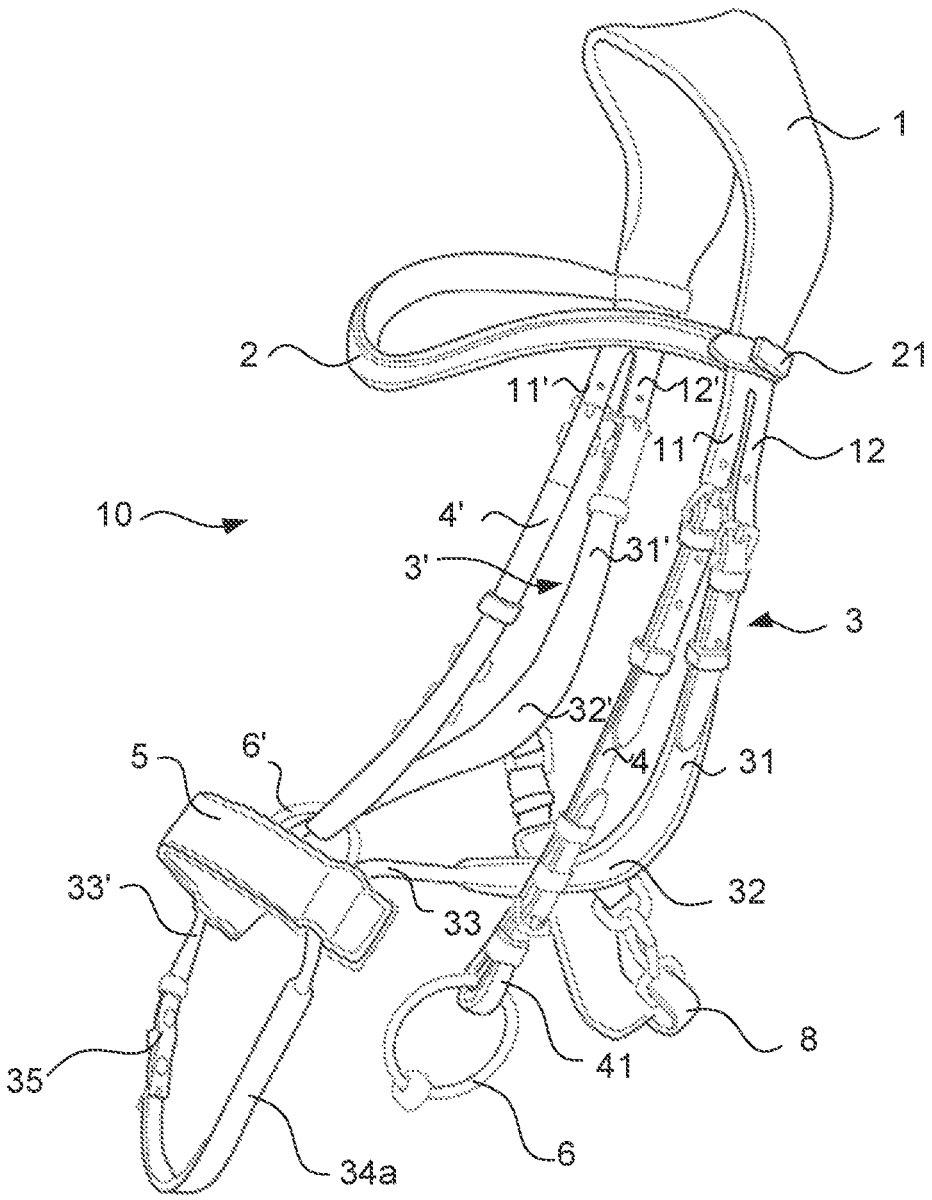
FIG. 2 schematically illustrates the bridle of FIG. 1.

The lower noseband closure 34*a* will connect with the corresponding structure under the horse's chin. Such connection may be length adjustable. For example, a buckle arrangement 35 as illustrated in FIG. 2 may be provided.

The noseplate 5 may be formed of at least two layers of material. A first layer may be an outer layer, that is to be exposed, and a second layer may be an inner layer, that is to contact the horse.

The outer layer may be the one that carries most of the tensional load and may be formed of a strap of leather, fabric or the like.

The inner layer may be a liner, which also may be made of leather, fur, fabric or the like.

The inner layer may be thinner than the outer layer. Moreover, it may be less rigid and generally softer and/or smoother.

It is possible to provide a third layer between the outer layer and the inner layer. This third layer may provide a cushioning or padding and may be formed of a foamed polymeric material, a rubber or elastomeric material, or a three dimensional fiber web material.

The second layer, and optionally also the third layer, may present an edge portion, which extends beyond an edge portion of the first layer, such that the edge portion of the second layer will be exposed.

The noseband and the cheek piece may be arranged as illustrated, with the cheek piece connected to the headstall above the noseband. Alternatively, the cheek piece and the noseband may be reversed, such that the noseband is connected to the headstall above the cheek piece. The choice will be dependent on the horse's anatomy.

The headstall 1 will now be described more in detail with reference to FIGS. 1, 2 and 3*a*-3*b*.

Between the end portions, the headstall comprises a part which has a varying width. A narrowest portion is provided at the respective end portion and a widest portion is provided at the center of the headstall 1, as seen in its length direction.

The widest portion may present a width w1 of at least 150% of a width of the narrowest portion w3, e.g. at least 200% or at least 250%.

Figure 3A:
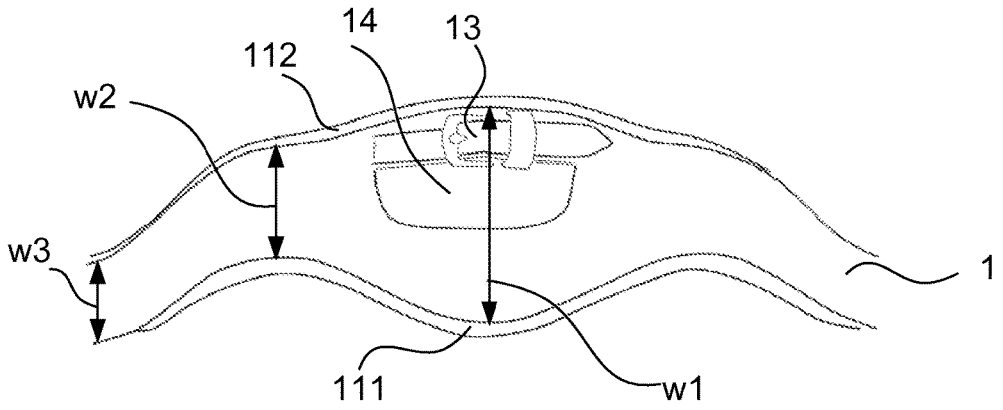
FIGS. 3*a*-3*c* schematically illustrate different embodiments of a headstall.
Figure 3B:
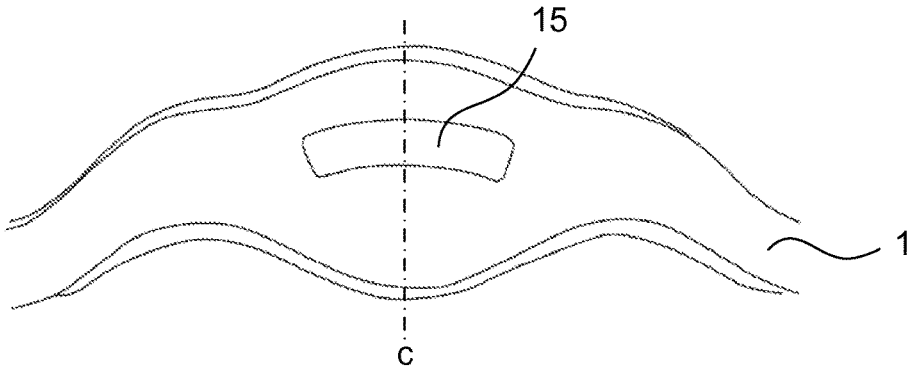

FIGS. 3*a*-3*b* schematically illustrate different embodiments of a portion of a headstall 1. The headstall 1 will present a length direction, extending between the end portions of the headstall, and a width direction, perpendicular to the length direction. This width direction coincides with a length direction of the horse c.

The headstall 1 may be formed of at least two layers of material. A first layer may be an outer layer, that is to be exposed, and a second layer may be an inner layer, that is to contact the horse.

The outer layer may be the one that carries most of the tensional load and may be formed of a strap of leather, fabric or the like.

The inner layer may be a liner, which also may be made of leather, fur, fabric or the like.

The inner layer may be thinner than the outer layer. Moreover, it may be less rigid and generally softer and/or smoother.

It is possible to provide a third layer between the outer layer and the inner layer. This third layer may provide a cushioning or padding and may be formed of a foamed polymeric material, a rubber or elastomeric material, or a three dimensional fiber web material.

The second layer, and optionally also the third layer, may present an edge portion, which extends beyond an edge portion of the first layer, such that the edge portion of the second layer will be exposed.

FIG. 3*a* illustrates an embodiment having a forward edge 111 and a rearward edge 112. The forward edge 111 may be curved, providing generally the shape of an S on each side of the middle.

Thus, on each side of the middle, there may be provided an edge recess for receiving a respective ear of the horse.

From the respective edge recess and towards the middle, the width w3 may increase substantially, for example by at least 50%.

Part of this width increase may be provided at the rearward edge 112 of the headstall 1.

The headstall 1 may be provided with a length adjustable member 13, which may cause part of the headstall 1, as seen in the width direction, to contract, such that the headstall 1 will be curved as seen in a plane along the width direction.

At the middle of the headstall, there may be provided a recess 14, which may extend along the length direction, across the middle and also along the width direction. For example, the recess may have a greater extent in the length direction than in the width direction.

The function of the recess 14 is to render the headstall 1 less rigid as seen in the width direction, that is, to facilitate its following the shape of the horse's neck.

The recess 14 may extend all the way through the first layer, such that the second and/or third layers may be exposed through the recess.

Figure 3C:
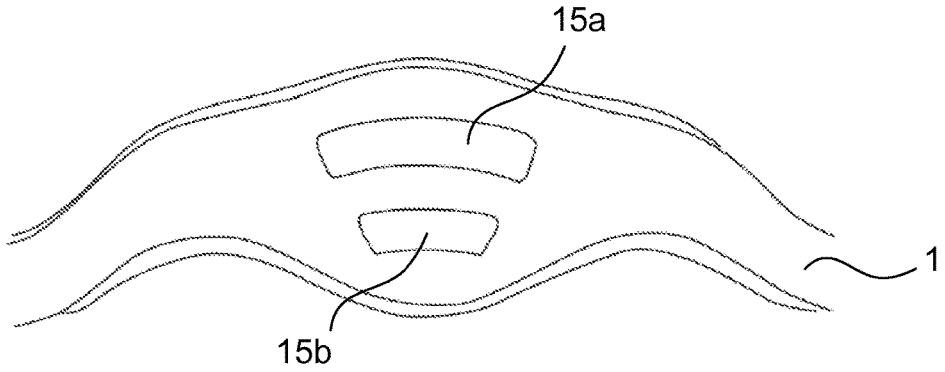

Alternative embodiments of such recesses are disclosed in FIGS. 3*b* and 3*c*.

In FIG. 3*b*, there is only a single recess 15 having the shape of a slot.

In FIG. 3*c*, there are two recesses 15*a* and 15*b*, each having the shape of a slot, but being of different lengths.

A width of these recesses may be on the order of 10%-50% of the maximum width of the headstall 1, e.g. 20%-40%.

A length of a recesse may be on the order of 1-6 times of the width of the recess, e.g. 2-5 times.

Figure 4:
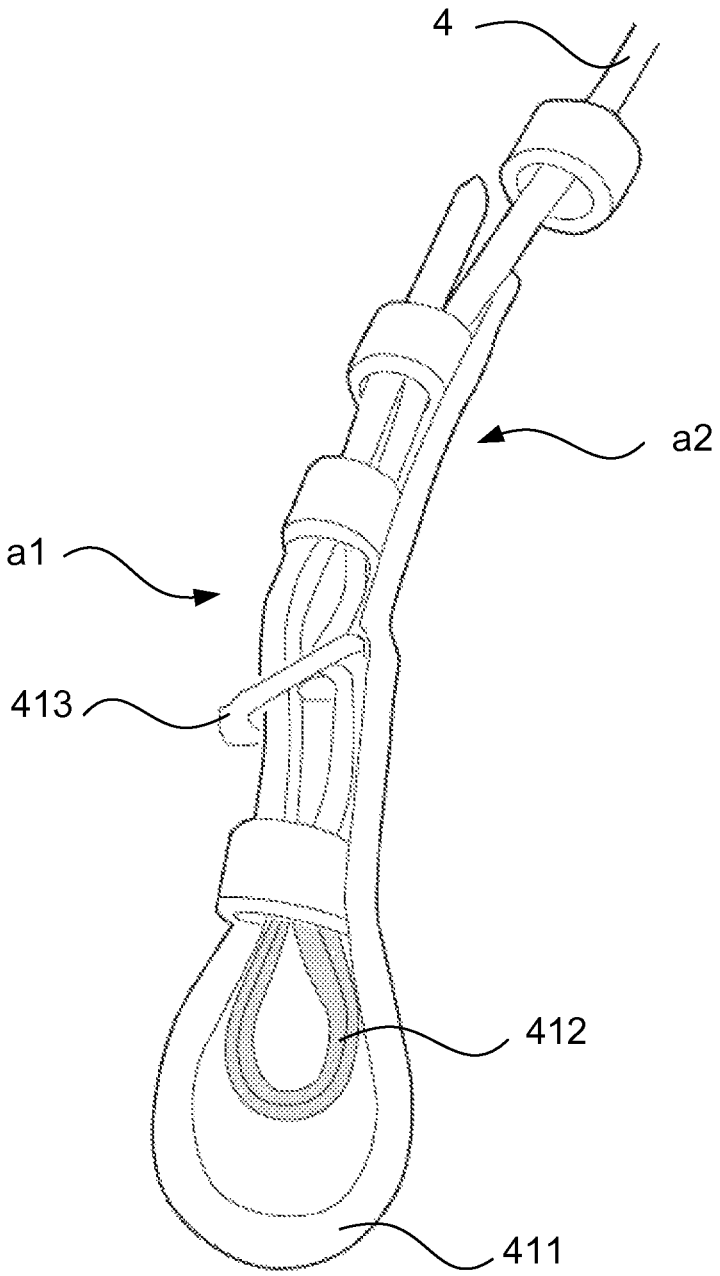
FIG. 4 schematically illustrates embodiments of a bit connector.

FIG. 4 schematically illustrates a bit connector 41. The bit connector 41 may form part of, or connect to, a cheek piece. In the illustrated example, the bit connector 41 connects to the cheek piece 4.

The bit connector 41 comprises an outer loop 411, which is formed by a first strap, and an inner loop 412, which is formed by a second strap.

The inner loop is 412 smaller than the outer loop 411.

The first strap may be formed of the same material as the remainder of the bridle, such as leather, fabric or reinforced polymer material.

The second strap may be formed of a material that is more elastic and/or resilient than the first material. For example, the second strap may comprise a rubber or rubber elastic material.

A proximal portion a2 of the first strap may be attached to, integrated with or formed in one piece with, the cheek piece 4. A distal portion of the first strap a1 may be releasably connectable with the proximal portion a2, so as to form the loop. The connection may be provided by a buckle 413, as illustrated.

A proximal portion a2 of the second strap may be attached to or integrated with the cheek piece 4. A distal portion a1 of the second strap may be attached to or integrated with the distal portion of the first strap a1.

A distance between the proximal and distal portions of the first strap may be greater than a distance between the proximal and distal portions of the second strap, such that the second strap will form the smaller inner loop 412 inside the larger outer loop 411.

With the loop formed, the bit connector 41 will present a distal end, with a distal part of the outer loop 411 being closer to the distal end than a distal part of the inner loop 412.

Hence, when the bit ring 6 is received in the bit connector 41, it will be received and held in the inner loop 412 while not subjected to load. When subjected to tensional load, the inner loop 412 will expand until the bit ring 6 contacts the outer loop 411. Hence, the bit ring 6 will be biased away from the distal portion of the outer loop 411.

This arrangement provides for a close fit of the bridle 10, while allowing for some expansion when the horse moves and/or chews on the bit.

Figure 5A:
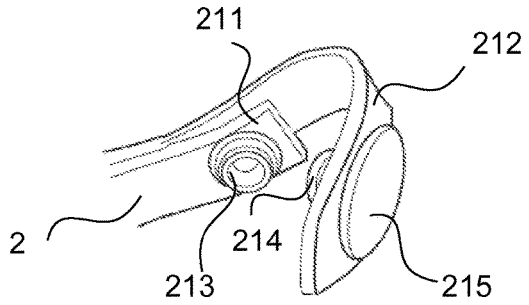
FIG. 5*a*-5*k* schematically illustrate different embodiments of a browband connector.

FIG. 5*a* schematically illustrates a connection between a browband 2 and the end portion of the headstall 1, just above the bifurcation. In FIG. 5*a*, the connector arrangement is in an open state.

The browband 2 comprises an elongate part having a pair of end portions 211 and 212 which releasably connect to the headstall 1 at respective sides of the horse's head.

The browband 2 may be formed of one or more layers, e.g. from multiple layers just as was described with respect to the headstall 1.

At its end portions, the browband 2 may comprise a respective releasable connector arrangement for connection to the headstall end portion.

In the illustrated example, the connector arrangement comprises a first flap 212, which is arranged to encircle the headstall end portion and a second flap 211, which is to be arranged on the outside of the headstall end portion and slightly overlapping the latter.

On the first flap 212, there is provided a first part of a connecting device 214, here in the form of a male part of a snap fastener, arranged on the face of the first flap 212 which is to face the second flap 211. Other options include hook-and-loop type fasteners and hitch fasteners.

On the opposite face of the first flap 212, there may be provided a decorative element 215, which may display e.g. a logotype, name or coat of arms.

On the second flap 211, there is provided a female part 213 of a snap fastener, arranged on the face of the second flap 211 which faces the first flap 212.

Hence, through this arrangement, there is provided a browband 2 which is easily reliable and attachable to the headstall end portions, even when the bridle 10 is fitted onto a horse.

Figure 5B:
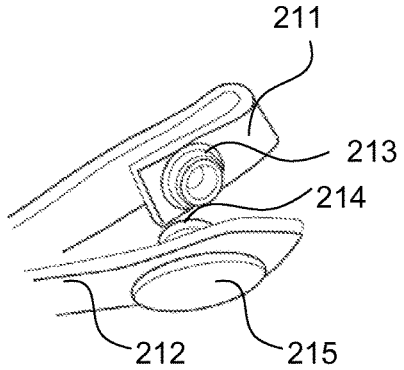

FIG. 5*b* schematically illustrates a connection between a browband 2 and the end portion of the headstall 1, just above the bifurcation. In FIG. 5*a*, the connector arrangement is in an open state.

The browband 2 comprises an elongate part having a pair of end portions 211 and 212 which releasably connect to the headstall 1 at respective sides of the horse's head.

The browband 2 may be formed of one or more layers, e.g. from multiple layers just as was described with respect to the headstall 1.

At its end portions, the browband 2 may comprise a respective releasable connector arrangement for connection to the headstall end portion.

In the example in FIG. 2*b*, the connector arrangement comprises a first flap 212, which forms an extension of the browband, and a second flap 211, which is arranged to encircle the headstall end portion.

The first flap 212 is to be arranged on the outside of the headstall end portion and slightly overlapping the second flap 211.

On the first flap 212, there is provided a first part of a connecting device 214, here in the form of a female part of a snap fastener, arranged on the face of the first flap 212 which is to face the second flap 211. Other options include hook-and-loop type fasteners and hitch fasteners.

On the opposite face of the first flap 212, there may be provided a decorative element 215, which may display e.g. a logotype, name or coat of arms.

Figure 5C:
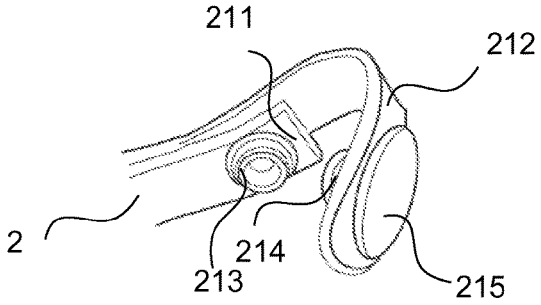

On the second flap 211, there is provided a male part 213 of a snap fastener, arranged on the face of the second flap 211 which faces the first flap 212. FIG. 5*c* schematically illustrates another design of the connector arrangement in FIG. 5*a*, but wherein the tip of the first flap 212 is rounded rather than pointed. In FIG. 5*a*, the connector arrangement is in an open state.

Figure 5D:
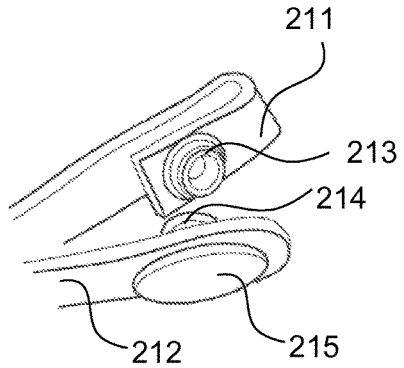

FIG. 5*d* schematically illustrates another design of the connector arrangement in FIG. 5*b*, but wherein the tip of the first flap 212 is rounded rather than pointed.

Figure 5E:
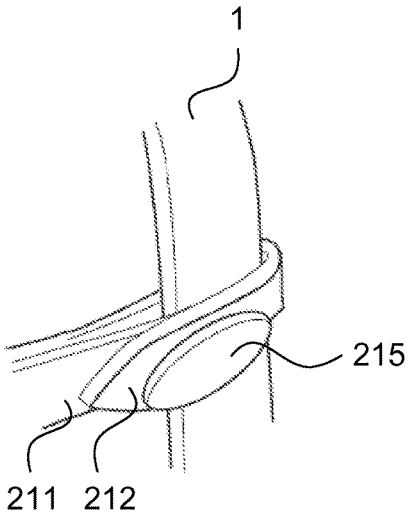

FIG. 5*e* schematically illustrates the embodiment of FIG. 5*a*, but in the connected state.

Figure 5F:
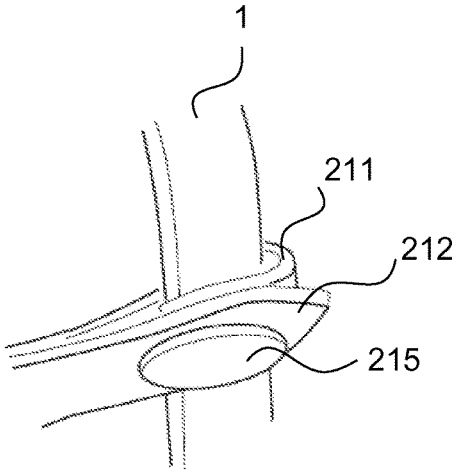

FIG. 5*f* schematically illustrates the embodiment of FIG. 5*b*, but in the connected state.

Figure 5G:
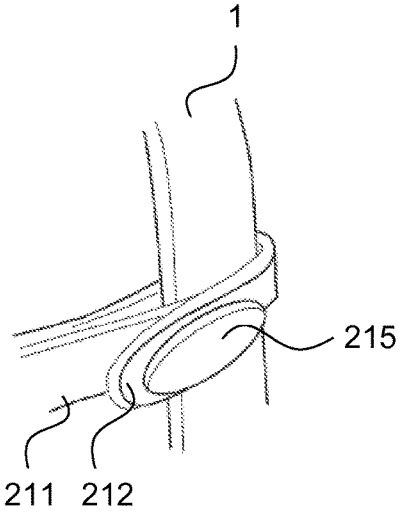

FIG. 5*g* schematically illustrates the embodiment of FIG. 5*c*, but in the connected state.

Figure 5H:
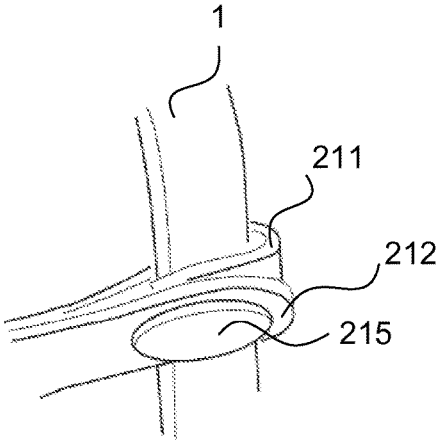

FIG. 5*h* schematically illustrates the embodiment of FIG. 5*d*, but in the connected state.

Figure 5I:
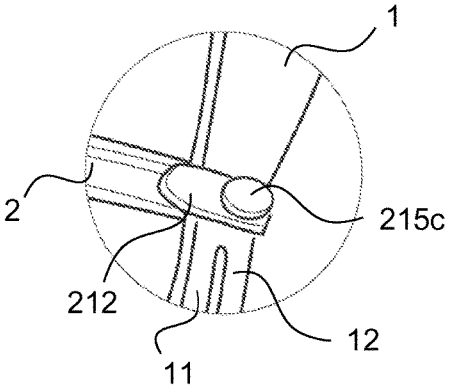
Figure 5J:
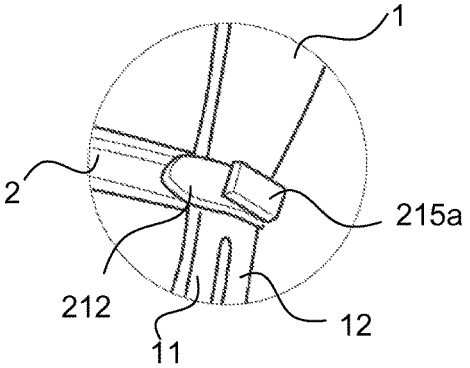
Figure 5K:
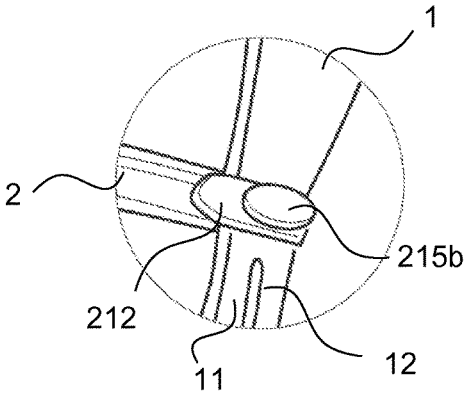

FIGS. 5*i*-5*k* illustrate different embodiments of decorative elements.

Figure 6:
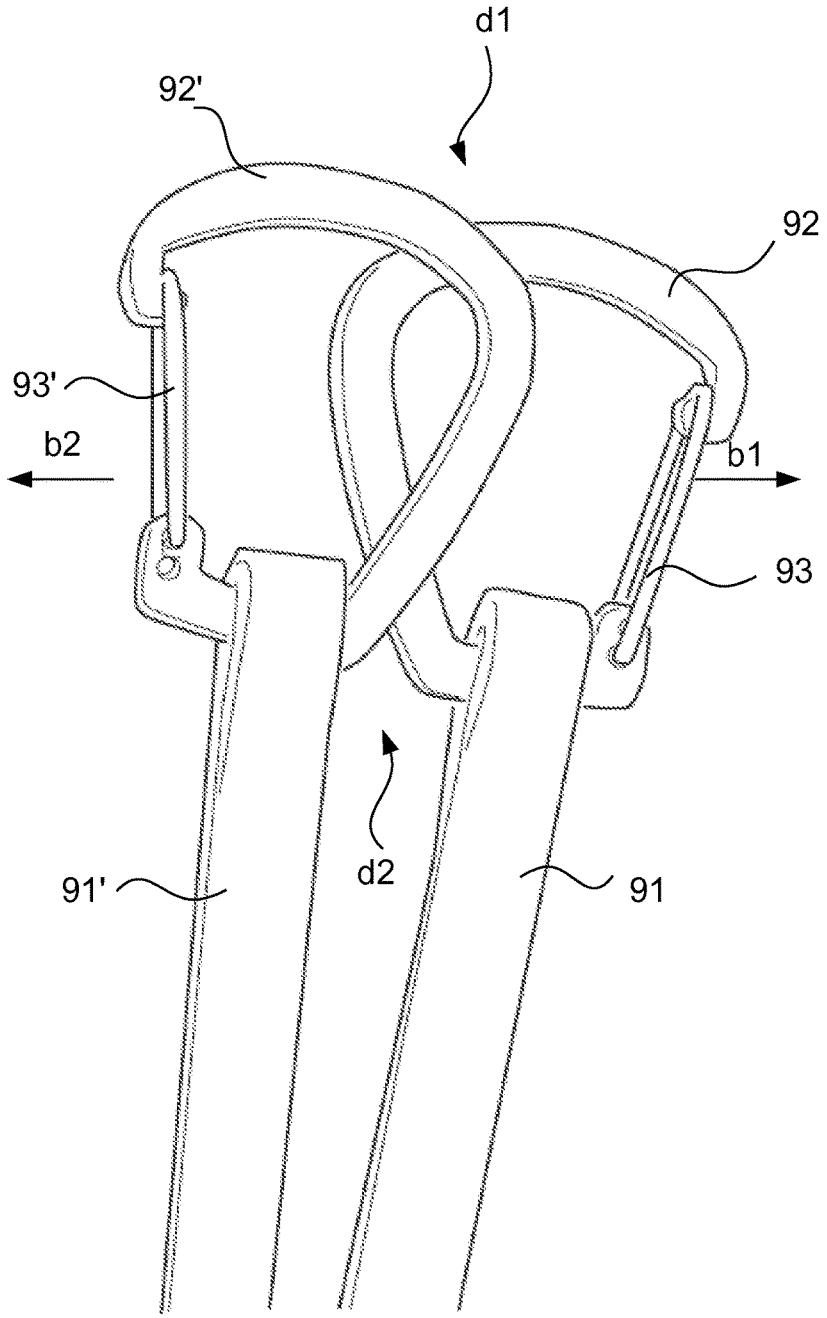
FIG. 6 schematically illustrate a part of a martingale.

FIG. 6 illustrate a part of a martingale. As is conventionally known, a martingale comprises a first end (not shown), which is adapted to connect to a girth (not shown). A second end of the martindale is bifurcated so as to present a pair of sub ends 91 and 91'. These sub ends comprise a connector 92 and 92' for connecting to a respective rein. Such connection should allow the martingale to slide easily along the rein.

In the illustrated example, the connectors 92 and 92' are formed by a respective D-shaped carabiner, comprising a proximal portion d2 for attaching to the martindale strap, a distal portion d1 for connecting to the rein, an opening and a jaw 93 and 93' closing the opening. The jaw 93 and 93' may be biased outwardly such that it will not open unintentionally.

Preferably, the openings should be arranged to face in opposite directions b1 and b2 away from each other.

The distal portion d1 of the carabiner 92 and 92' should present a radius of curvature which is greater than 75% of a greatest length of the carabiner 92 and 92', preferably greater than 100% or greater than 125% of the greatest length of the carabiner 92 and 92'.

Figure 7A:
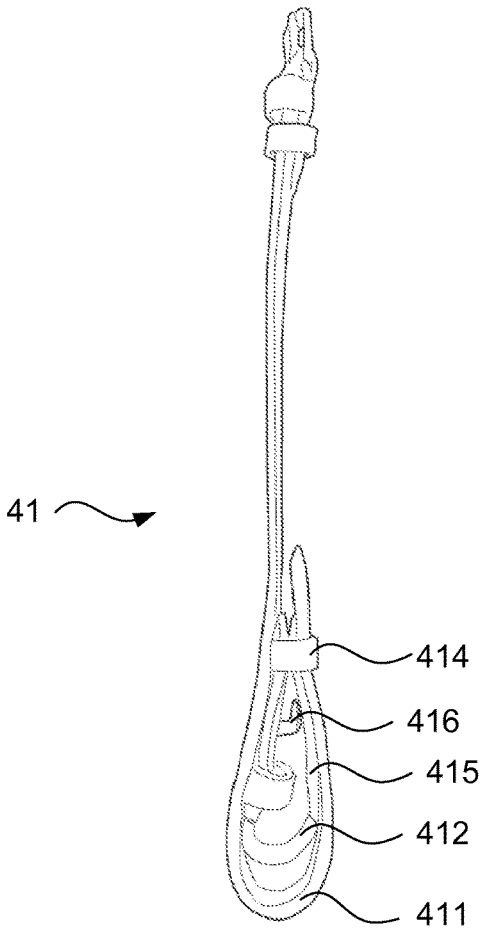
FIGS. 7*a*-7*b* schematically illustrate a cheek piece including a bit connector according to a second embodiment.

Referring to FIG. 7*a*, there is illustrated another embodiment of a cheek piece with a bit connector 41.

This bit connector comprises the same parts as the one disclosed with reference to FIG. 4, i.e. an outer loop 411 and an inner, elastic loop 412.

However, a distal portion 415 of the inner loop is formed at least partially of a material or a part which is less elastic than that of the inner loop 412. Such material may be e.g. leather, fabric or reinforced polymer material. The distal portion 415 may be joined end-to-end with the elastic part forming the inner loop 412 or it may be laminated as a layer to a the distal portion of the inner loop, such that it will effectively receive any tensional load provided on the distal portion 415.

Figure 7B:
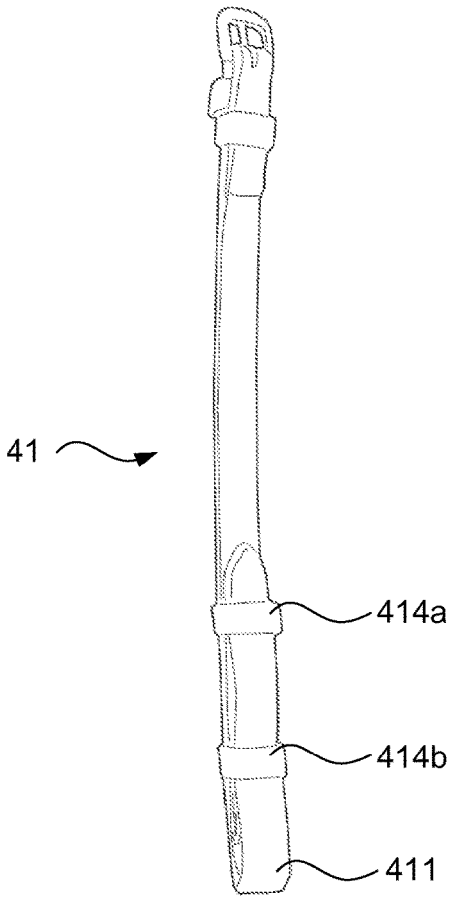

The distal part of the outer loop 411 extends at least as far as the distal portion 415, preferably further, as illustrated in FIGS. 7*a*-7*b*.

The distal portion 415 may comprise one or more recesses or holes on its inside and its back side is not fully attached to the distal portion of the outer loop 412, such that the head of a hitch 416 (here illustrated as a "French hitch"—a hitch having a generally L-shaped head), may enter the hole and be received in a pocket formed between the portion 415 and the distal part of the outer loop 411.

Hence, the distal portion 415 may be joined to the distal part of the outer loop 411 at one or positions along the longitudinal direction of the distal part 415 e.g. by stitching and/or glue. In the alternative, or as a supplement, the distal portion 415 may be joined to the outer loop along its edges, e.g. by stitching.

The invention claimed is:

1. A bridle for an equine, comprising:

a headstall, opposite ends of which presenting a respective bifurcation providing a plurality of cheek pieces and a respective noseband, a browband, opposite ends of which being connected to the headstall near the bifurcation, a bit connector, provided at an end of one of the cheek pieces, and a noseplate, adapted to extend over the equine's nose, wherein each of the plurality of cheek pieces extend from the respective bifurcation to the bit connector, wherein the headstall presents a varying width, with a maximum width being at least 200% of a minimum width, wherein the browband is releasably connected to the headstall, such that it can be removed while the bridle is fitted to the equine, wherein the bit connector comprises an inner loop and an outer loop, the inner loop being more resilient than the outer loop, whereby the inner loop is enclosed by the outer loop and smaller than the outer loop, such that a bit ring is simultaneously receivable in the inner and outer loops, and wherein the noseplate comprises inner and outer layers, wherein one of the inner and outer layers provides a connection to the noseband and wherein the other one of the inner and outer layers is less rigid than the other, wherein the noseband comprises:

an extension and an upwardly curved portion that is positioned behind the bit and extends upwardly past the cheek piece, wherein the extension presents a portion that is plastically deformable, a first portion which extends straight and parallel from the bifurcation at an angle less than 10° with the cheek piece, a second portion, which is curved upwardly at a plane of a respective strap, the second portion forms the respective noseband, such that it crosses the cheek piece, and a noseplate attachment portion, wherein the noseplate attachment portion comprises a core of a metal wire and is plastically deformable.

2. The bridle as claimed in claim 1, wherein the headstall comprises inner and outer layers, wherein the outer layer provides a connection to one of the cheek pieces and wherein the inner layer is less rigid than the outer layer.

3. The bridle as claimed in claim 2, wherein the headstall comprises a padding layer, arranged between the inner and outer layers.

4. The bridle as claimed in claim 1, wherein an edge of the inner layer, over at least part of the headstall, extends outside an edge of the outer layer.

5. The bridle as claimed in claim 1, wherein a central portion of the headstall present at least one recess providing reduced rigidity of the central portion.

6. The bridle as claimed in claim 1, wherein an end portion of the browband presents a connector for releasable connection to the headstall.

7. The bridle as claimed in claim 1, wherein the outer loop is formed by a first strap, wherein the inner loop is formed by a second strap, which is more resilient than the first strap, wherein a proximal portion of the second strap is attached to a proximal portion of the first strap, wherein a distal portion of the second strap is attached to a distal portion of the first strap, and wherein a length between the distal and proximal portions of the first strap is greater than a length between the distal and proximal portions of the second strap.

8. The bridle as claimed in claim 7, wherein the distal portion of the straps is releasably connectable to the proximal portion of the straps, such that the loops are formed when such connection is provided.

9. The bridle as claimed in claim 1, wherein the noseplate attachment portion is provided above the bit and bit ring, and wherein the noseplate is slideably attached to the noseplate attachment portion such that a height position of the noseplate is adjustable.

10. The bridle as claimed in claim 1, wherein the noseplate is connected to the noseplate attachment portion, at a portion of the noseplate attachment portion having a circular cross section, such that the noseplate is rotatable about the noseplate attachment portion.

11. The bridle as claimed in claim 1, wherein the noseplate is connected to the noseband at a position on a side of a nasal bridge of the equine, above a bit when the bridle is applied to the equine.

12. A bridle for an equine, the bridle comprising:

a headstall, opposite ends of which presenting a respective bifurcation providing a respective cheek piece and a respective noseband, a browband, opposite ends of which being connected to the headstall near the bifurcation, a bit connector, provided at an end of one of the cheek pieces, and a noseplate, adapted to extend over the equine's nose, wherein each cheek piece extends from the respective bifurcation to the bit connector, and wherein the noseband comprises:

a first portion which extends straight and parallel from the bifurcation at an angle less than 10° with the cheek piece, a second portion, which is curved upwardly at a plane of a respective strap, the second portion forms the respective noseband, such that it crosses the cheek piece, and a noseplate attachment portion, wherein the noseplate attachment portion comprises a core of a metal wire and is plastically deformable.

13. The bridle as claimed in claim 12, wherein the noseplate attachment portion is provided above the bit and bit ring, and wherein the noseplate is slideably attached to the noseplate attached portion such that a height position of the noseplate is adjustable.

14. The bridle as claimed in claim 12, wherein the noseplate is connected to the noseplate attachment portion, at a portion of the noseplate attachment portion having a circular cross section, such that the noseplate is rotatable about the noseplate attachment portion.

15. A bridle for an equine, the bridle comprising:

a headstall, opposite ends of which presenting a respective bifurcation providing a respective cheek piece and a respective noseband, a browband, opposite ends of which being connected to the headstall near the bifurcation, a bit connector, provided at an end of one of the cheek pieces, and a noseplate, adapted to extend over the equine's nose, wherein each cheek piece extends from the respective bifurcation to the bit connector, and wherein the noseband comprises:

a first portion which extends straight and parallel from the bifurcation at an angle less than 10° with the cheek piece, a second portion, which is curved upwardly at a plane of a respective strap, the second portion forms the respective noseband, such that it crosses the cheek piece, and a noseplate attachment portion, wherein the noseplate is connected to the noseplate attachment portion at a respective portion of the noseplate attachment portion having a circular cross section, such that the noseplate is rotatable about the noseplate attachment portion.

* * * * *